US011566195B2

(12) United States Patent
Harada et al.

(10) Patent No.: US 11,566,195 B2
(45) Date of Patent: Jan. 31, 2023

(54) FUEL OIL COMPOSITION

(71) Applicant: Idemitsu Kosan Co., Ltd., Tokyo (JP)

(72) Inventors: Shohei Harada, Kanagawa (JP); Yasuyuki Komatsu, Chiba (JP); Rei Yoshida, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 17/417,790

(22) PCT Filed: Dec. 26, 2019

(86) PCT No.: PCT/JP2019/051087
§ 371 (c)(1),
(2) Date: Jun. 24, 2021

(87) PCT Pub. No.: WO2020/138272
PCT Pub. Date: Jul. 2, 2020

(65) Prior Publication Data

US 2022/0073830 A1 Mar. 10, 2022

(30) Foreign Application Priority Data

Dec. 28, 2018 (JP) ..... JP2018-248216

(51) Int. Cl.
*C10L 1/08* (2006.01)

(52) U.S. Cl.
CPC ..... *C10L 1/08* (2013.01); *C10L 2200/0446* (2013.01); *C10L 2270/026* (2013.01)

(58) Field of Classification Search
CPC ..... C10L 1/08; C10L 2200/0446; C10L 2270/026
See application file for complete search history.

(56) References Cited

U.S. PATENT DOCUMENTS

| | | | | |
|---|---|---|---|---|
| 10,760,020 | B2 | 9/2020 | Kashio et al. | |
| 2018/0340126 | A1 * | 11/2018 | Klussman | C10G 47/02 |
| 2019/0300806 | A1 | 10/2019 | Kashio et al. | |

FOREIGN PATENT DOCUMENTS

| | | | | |
|---|---|---|---|---|
| JP | 2014-51591 | A | 3/2014 | |
| JP | 2018-165365 | A | 10/2018 | |
| JP | 2018-165366 | A | 10/2018 | |
| JP | 2018-165367 | A | 10/2018 | |
| WO | 2018/101244 | A1 | 6/2018 | |
| WO | WO-2018101244 | A1 * | 6/2018 | C10L 1/04 |

OTHER PUBLICATIONS

WO2018101244A Description English Translation (Year: 2018).*
WO2018101244A English Translation (Year: 2018).*
International Search Report dated Mar. 10, 2020 issued in corresponding PCT/JP2019/051087 application (2 pages).

* cited by examiner

*Primary Examiner* — Ellen M McAvoy
*Assistant Examiner* — Chantel L Graham
(74) *Attorney, Agent, or Firm* — Millen White Zelano and Branigan, PC; Csaba Henter

(57) ABSTRACT

Provided is a fuel oil composition that has a sulfur content of 0.50 mass % or less but yet has a storage stability, long-term storage stability, combustion performance, low-temperature fluidity and kinetic viscosity sufficient for use in ships. A fuel oil composition that has a sulfur content of 0.50 mass % or less, aromatic content of 50.0 to 75.0 mass %, a mass ratio of sum of paraffin and asphaltene to the sum of aromatic and resin is 0.20 to 0.80 wherein the paraffin, the asphaltene, the aromatic and the resin are measured using a TLC/FID method respectively, a CCAI is 860 or less, a kinematic viscosity (50° C.) is 10.00 to 180 0 $mm^2/s$, and a pour point of 25.0° C. or less.

15 Claims, No Drawings

FUEL OIL COMPOSITION

TECHNICAL FIELD

The present invention relates to a fuel oil composition for use in external combustion apparatus such as boilers or diesel engines of ships and so on.

BACKGROUND OF THE ART

Fuel oil compositions, which are widely used as fuel for ships traveling outside the jurisdictional area, are required to be excellent in ignition performance and combustion performance and not to generate combustion failure, as ship fuel. Therefore, as a technique for satisfying these required performances, Patent Document 1 (Japanese Patent Publication 2014-51591) discloses to set an ignitability index to be 0 or more and less than 15, wherein the index is calculated from a density at 15° C., a kinematic viscosity at 50° C., and temperature by thermal weight-differential thermal analysis at which temperature weight reduces by 10%, 50%, and 90% under a nitrogen atmosphere.

On the other hand, in recent years, there has also been a demand for improvements in the exhaust gas from marine transportation, which had been said to be energy-efficient and relatively low in emissions, and regulations on the sulfur content of marine fuel are advancing mainly to reduce the sulfur oxides (SOx) and black smoke emitted from ships.

Since sulfur oxides and particulate matter are attributed to sulfur contained in fuel, the sulfur content of fuel oil compositions, which are widely used as fuels for ships traveling outside the jurisdictional area, is currently 3.5 mass % or less, but in 2020, it is mandated to be 0.5 mass % or less.

Therefore, there has been proposed a fuel oil composition which satisfies the required property as a fuel while setting the sulfur content of the fuel oil composition to 0.5 mass % or less. For example, Patent Document 2 (Japan Patent Publication 2018-165365) discloses a fuel oil composition containing a direct desulfurized heavy oil and at least one of slurry oil and catalytic cracked gas oil, wherein a ratio of an asphaltene content to a sum of an aromatic content and a resin content relative to a total mass of the composition is 0.090 or less, and a sulfur content is 0.50 mass % or less based on a total mass of the composition.

In addition, Patent Document 3 (Japan Patent Publication 2018-165366) discloses a fuel oil composition containing slurry oil and blend materials for mixing other than the slurry oil comprising 2 or more kinds containing a residual fraction, wherein the content of the residual fraction is 0.3 volume % to 5.0 volume % based on the total volume of the fuel oil composition, and a sulfur content is 0.5 mass % or less.

Further, Patent Document 4 (Japan Patent Publication 2018-165367) proposes a fuel oil composition contains slurry oil and a blend material having a CCAI (Calculated Carbon Aromatic Index) of 850 or less and comprising 1 or 2 or more other than slurry oil, wherein the content of the slurry oil is 20.0 volume % to 85.0 volume % based on the total volume of the fuel oil composition, and the content of the 1 or 2 or more blend materials other than the slurry oil is 15.0 volume % to 80.0 volume % based on the total volume of the fuel oil composition, and the sulfur content is 0.5 mass % or less.

PRIOR ART DOCUMENTS

Patent Document

[Patent Document 1] Japan Patent Publication 2014-51591
[Patent Document 2] Japan Patent Publication 2018-165365
[Patent Document 3] Japan Patent Publication 2018-165366
[Patent Document 4] Japan Patent Publication 2018-165367

SUMMARY OF THE INVENTION

Problem to be Solved by the Invention

However, in the technique described in the patent document relating to the C-type heavy fuel oil composition, it is not assumed that the sulfur content is unnecessarily low as long as it satisfies a predetermined standard (e.g., 0.5 mass % or less of JIS K2205), and as described above, the sulfur content of the C-type heavy fuel oil composition widely used as fuels for ships traveling outside the jurisdictional region is 3.5 mass % or less.

Therefore, there is a possibility that the problem which could appear in the C-type heavy fuel oil composition when the sulfur content is lowered cannot be solved by the technique described in the above-described patent document. Specifically, with a decrease in the sulfur content, there is a concern as to whether storage stability, long-term storage stability, ignitability, combustion performance, low-temperature fluidity and kinematic viscosity become able to withstand use in ships.

Accordingly, it is an object of the present disclosure to provide a fuel oil composition having storage stability, long-term storage stability, ignitability, combustion performance, low-temperature fluidity and kinematic viscosity which can withstand use in ships even if the sulfur content is 0.50 mass % or less.

Means for Solving the Problems

In order to achieve the above object, the present inventors have conducted extensive research. One aspect of the present disclosure is a fuel oil wherein a sulfur content is 0.50 mass % or less, an aromatic content is 50.0 to 75.0 mass %, a mass ratio of sum of paraffin and asphaltene to the sum of aromatic and resin is 0.20 to 0.80 wherein the sums are measured using a TLC/FID method, a CCAI is 860 or less, a kinematic viscosity (50° C.) is 10.00 to 180 0 $mm^2/s$, and a pour point of 25.0° C. or less.

Effect of the Invention

According to the present disclosure, it is possible to provide a fuel oil composition having storage stability, long-term storage stability, ignitability, combustion performance, low-temperature fluidity and kinematic viscosity which can withstand use in ships even if the sulfur content is 0.50 mass % or less.

DESCRIPTION OF EMBODIMENTS

The fuel oil composition according to the present disclosure is a fuel oil composition satisfying JIS K 2205 standard.

The fuel oil composition according to the present disclosure has a sulfur content of 0.50 mass % or less. Sulfur is one of the sources of environmental pollution, and if the sulfur content is too large, the emission of sulfur oxides and particulate matter in the exhaust gas increases. Therefore, it is preferable that the sulfur content is small. However, if the sulfur content is too small, the kinematic viscosity may decrease, and the self-lubricating property of the fuel oil composition may decrease. Therefore, the sulfur content is preferably 0.15 mass % or more, more preferably 0.20 mass % or more, still more preferably 0.25 mass % or more, and particularly preferably 0.30 mass % or more.

The fuel oil composition according to the present disclosure includes paraffin. The paraffin content is preferably 60.0 mass % or less, more preferably 24.0 to 45.0 mass %, and still more preferably 35.0 to 42.0 mass %. In the present disclosure, paraffin is a component containing paraffin as a main component. The paraffin content is measured using, for example, a TLC/FID (thin layer chromatography/flame ionization detector) method. In TLC/FID method, the paraffin is separated after being developed by n-hexane. If the paraffin component is small, in the case of the fuel oil composition, the ratio of the aromatic affecting the ignition combustion performance to the whole increases wherein a problem such as a poor starting performance of the engine may be caused. On the other hand, when the paraffin content is large, the filter oil permeability performance, storage stability, long-term storage stability, and low-temperature fluidity may be deteriorated.

The fuel oil composition according to the present disclosure includes aromatic. The aromatic includes, for example, a 1 (one) ring aromatic having an alkyl group or a naphthene ring in benzene, a 2 ring aromatic having an alkyl group or a naphthene ring in naphthalene, and a 3 ring aromatic having an alkyl group or a naphthene ring in phenanthrene or anthracene. The aromatic content, in the fuel oil composition, is from 50.0 to 75.0 mass %, preferably from 53.0 to 70.0 mass %, and more preferably from 55.0 to 65.0 mass %. The aromatic content is measured using, for example, a TLC/FID method. In TLC/FID method, the aromatic is not developed by n-hexane and is separated after being developed by toluene. The higher the aromatic content, the higher the long-term storage stability because it disperses the asphaltene content. However, if the aromatic content is too large, ignitability and combustion performance may be deteriorated, and as a result, problems such as poor starting performance of the engine may occur.

The fuel oil composition according to the present disclosure includes resin. The resin content is preferably 2.0 mass % or less, more preferably 0.2 to 2.0 mass %, and still more preferably 0.5 to 1.6 mass %, in the fuel oil composition from the viewpoint of sludge suppression during storage and combustion performance. It is preferable that the resin content is smaller from the viewpoint of combustion performance, but from the viewpoint of suppressing sludge, it is preferable to include a small amount. The resin content is determined using, for example, a TLC/FID method. In TLC/FID method, the resin is not developed by n-hexane and toluene, and is separated after being developed by a mixed solvent of methanol and dichloromethane.

The fuel oil composition according to the present disclosure includes asphaltene. It is preferable that the asphaltene content is small from the viewpoint of sludge suppression during storage and combustion performance. The asphaltene content, in the fuel oil composition, is preferably 5.0 mass % or less, more preferably 4.5 mass % or less, and still more preferably 2.5 mass % or less. The asphaltene content is measured using, for example, a TLC/FID method. In TLC/FID method, the asphaltene is not developed by any of n-hexane, toluene, and mixed solvents of methanol and dichloromethane. It is preferable that asphaltene content is smaller from the viewpoint of long-term storage stability in a case where the fuel oil composition is used as a fuel oil for an outboard ship, a case where the fuel oil composition is warmed and stored in a tank such as a shipping base, or the like.

The mass ratio of the sum of the paraffin and asphaltene to the sum of the aromatic and resin ((paraffin+asphaltene)/(aromatic+resin)) is from 0.20 to 0.80, preferably from 0.37 to 0.75, and more preferably from 0.37 to 0.72. If this mass ratio is large, long-term storage stability may be deteriorated or oil permeation performance may be deteriorated. On the other hand, if the mass ratio is small, ignitability is deteriorated, which may cause problems such as poor engine startability. This mass ratio is obtained by determining the masses of aromatic, resin, paraffin, and asphaltene using TLC/FID method, respectively, and is obtained from the sum of the masses of aromatic and resin and the sum of the masses of paraffin and asphaltene.

The carbon residue content, in the fuel oil composition, is preferably from 0.10 to 10.00 mass %, more preferably from 0.30 to 6.00 mass %, still more preferably from 1.00 to 5.00 mass %, and particularly preferably from 1.50 to 3.00 mass %. High carbon residue content may deteriorate filter oil permeability and combustion performance.

The content of ash, in the fuel oil composition, is preferably 0.050 mass % or less. If the ash content is large, the combustion performance may deteriorate.

The disclosed fuels compositions preferably have densities (15° C.) of less than or equal to 0.9910 g/cm$^3$, more preferably from 0.8700 to 0.9900 g/cm$^3$, more preferably from 0.8900 to 0.9700 g/cm$^3$, and particularly preferably from 0.9000 to 0.9500 g/cm$^3$. When the density is small, fuel consumption may be worse, and when the density is large, black smoke in the exhaust gas may increase or ignitability may be worse.

The fuel oil composition according to the present disclosure has a kinematic viscosity (50° C.) of 10.00 to 180.0 mm$^2$/s, preferably 20.00 to 120.0 mm$^2$/s, and more preferably 25.00 to 110.0 mm$^2$/s. If the kinematic viscosity (50° C.) is small, the lubricating performance may become worse. Furthermore, if the kinematic viscosity (50° C.) is too small, the spray in the combustion chamber may become worse, resulting in more unburned hydrocarbons in the exhaust gas. On the other hand, if the kinematic viscosity (50° C.) is too large, the spray state of the fuel in the combustion chamber may not be appropriate and the exhaust gas property may become worse. In order to reduce the sulfur content of the fuel oil composition, it is conceivable to blend a residual desulfurization component having a lower kinematic viscosity and an intermediate fraction having a lower kinematic viscosity into the fuel oil composition than atmospheric residue which is a main base component at the time of producing a fuel oil having a sulfur content of 3.5 mass % or less, and the kinematic viscosity tends to be small together with a decrease in the sulfur content, and in the case of such a fuel oil composition, the lubricating performance may be worse. Also, in a typical marine fuel supply system, the fuel oil composition is heated and fed into the combustion chamber. Thus, if the kinematic viscosity is too low, the viscosity of the fuel oil composition to be low by heating and may not be handled by existing fuel supply systems equipped in a ship. Therefore, it is preferable that the kinematic viscosity at the temperature at the time of supply at engine inlet is in appropriate range so that the fuel oil composition has a viscosity enough to apply an existing fuel supply line. Therefore, the kinematic viscosity (50° C.) of the fuel oil composition is preferably in the range described above. In order to adjust the kinematic viscosity (50° C.) of the fuel oil composition into such a range, for example, a cracked-based base component may be mixed with the residue base component in accordance with the kinematic viscosity of the residue base component obtained from the refining process of the refinery.

The fuel oil composition according to the present disclosure has a pour point of 25.0° C. or less, preferably 22.5° C. or less. When the fuel oil composition is used as a fuel for ships, the fuel tank in the ship may be heated to have the appropriate fluidity of the fuel. However, if the pour point is high, there is a possibility that wax is generated due to insufficient heating and the filter is clogged. In addition, when the pour point is high, it is necessary to keep heating at a high temperature, and therefore, energy cost is incurred.

The fuel oil composition according to the present disclosure has CCAI (Calculated Carbon Aromatic Index) of 860 or less, preferably 850 or less. CCAI is an index focusing on the relationship between the aromatic content, ignitability, and combustion performance. CCAI is calculated using the density and kinematic viscosity of heavy oil. When the density is relatively high, the aromatic content in the fuel oil composition becomes relatively large and CCAI becomes large. On the other hand, if the density is relatively low, the aromatic content in the fuel oil composition becomes relatively small and CCAI becomes small. In addition, large CCAI may deteriorate ignitability and cause problems such as engine start-up failure. In addition, when CCAI is small, there may be a large amount of unburned hydrocarbons in the exhaust gas. Therefore, CCAI is preferably 790 or more. Note that the influence of the kinematic viscosity on the combustion performance is as described above.

From the viewpoint of safety and storage, the fuel oil composition according to the present disclosure preferably has a flash point of 70.0° C. or more, more preferably 80.0° C. or more.

The fuel oil composition according to the present disclosure preferably has an estimated cetane number of 15.0 or more, more preferably 20.0 or more. If the estimated cetane number is low, ignitability may deteriorate. If the estimated cetane number is high, there is a possibility that the exhaust gas properties are deteriorated, for example, unburned hydrocarbons are apt to be generated. Therefore, the estimated cetane number is preferably 55.0 or less.

As an indicator for evaluating the storage stability of the fuel oil composition, it is preferable to use existing sludge and potential sludge. The existing sludge of the fuel oil composition according to the present disclosure is preferably 0.10 mass % or less, more preferably 0.05 mass % or less, still more preferably 0.02 mass % or less, and particularly preferably 0.01 mass % or less, from the viewpoint of storage stability.

The potential sludge of the fuel oil composition according to the present disclosure is preferably 0.10 mass % or less, more preferably 0.06 mass % or less, and still more preferably 0.03 mass % or less, from the viewpoint of long-term storage stability.

The fuel oil composition according to the present disclosure may be prepared using (i) one or 2 or more desulfurization residues obtained by distilling of the crude oil and desulfurizing, or (ii) a mixture of one or 2 or more cracked materials or intermediate fractions obtained by distilling of the crude oil, desulfurizing and cracking and a desulfurization residue so that the finally obtained composition has a specified property.

The fuel oil composition according to the present disclosure preferably contains a desulfurization residue component. The desulfurization residue component is, for example, a direct residual desulfurization component obtained from a direct residual desulfurization apparatus, or an indirect desulfurization residue obtained by indirect desulfurization of a vacuum distillation residue. From the viewpoint of kinematic viscosity and combustion performance, the content of the desulfurization residue is preferably 30.0 volume % or more, more preferably 30.0 to 70.0 volume %, and still more preferably 30.0 to 50.0 volume % in the fuel oil composition. If the mixing amount of the desulfurization residue is too small, the kinematic viscosity becomes low, and the lubricating performance of the fuel oil composition may decrease. On the other hand, if the mixing amount of the desulfurization residue is too large, the storage stability and the long-term storage stability may be deteriorated.

The aromatic content in the desulfurization residue is preferably 45.0 to 70.0 mass %, more preferably 50.0 to 60.0 mass %. If the aromatic content of the desulfurization residue is small, sludge may be easily generated, and if it is large, ignitability and combustion performance may be deteriorated. Densities of desulfurization residues (15° C.) are preferably above 0.8600 g/cm$^3$, more preferably from 0.9000 to 1.0000 g/cm$^3$. The sulfur content is preferably, for example, 0.10 to 1.50 mass %, and more preferably 0.10 to 0.70 mass %. The carbon residue content is, for example, 15.00 mass % or less.

The fuel oil composition according to the present disclosure may include cracked material fraction. The cracked material fraction is a fraction obtained in the cracking step in the crude oil refining process. The cracked material fraction is a fraction or residual oil with a boiling point of about 230-600° C. by-product from a fluidized catalytic cracker or a residual oil fluidized catalytic cracker. The cracked material fraction is, for example, catalytically cracked gas oil or catalytically cracked heavy oil. When a cracked material fraction is contained in the fuel oil composition, the content of the cracked material fraction is preferably 10.0 to 50.0 volume %, more preferably 10.0 to 30.0 volume %, in the fuel oil composition. The ignitability and combustion performance may be worse if the content of the cracked material fraction is large. When the amount of the cracked material fraction is small, low-temperature fluidity, storage stability, and long-term storage stability may be deteriorated.

When the cracked material fraction is catalytically cracked gas oil, the density (15° C.) is preferably above 0.9000 g/cm$^3$, more preferably from 0.9300 to 1.1000 g/cm$^3$. The kinematic viscosity (50° C.) is preferably between 2.000 and 2.500 mm$^2$/s. The sulfur content is preferably 0.20 to 0.50 mass %. The aromatic content is 70.0 mass % or more, more preferably 75.0 to 90.0 mass %. The content of aromatic of 2 ring or more is preferably 40.0 mass % or more, more preferably 40.0 to 60.0 mass %. The carbon residue content is preferably 0.10 mass % or less.

When the cracked material fraction is catalytically cracked heavy oil, the density (15° C.) is preferably above 0.9000 g/cm$^3$, more preferably from 0.9300 to 1.1000 g/cm$^3$. The kinematic viscosity (50° C.) is preferably between 100.0 and 180.0 mm$^2$/s. The sulfur content is preferably 0.10 to 1.20 mass %, and more preferably 0.30 to 0.60 mass %. The aromatic content is 70.0 mass % or more, more preferably 75.0 to 90.0 mass %. The carbon residue content is preferably from 5.00 to 8.00 mass %.

The fuel oil composition according to the present disclosure preferably contains 1 or more kinds of base component selected from the group consisting of a desulfurization residue and a cracked material fraction, preferably 45.0 volume % or more, and more preferably 60.0 volume % or more.

The fuel oil composition according to the present disclosure may include a middle distillate. In this case, the content of the middle distillate is preferably 40.0 volume % or less, more preferably 30.0 to 40.0 volume %, in the fuel oil composition. If the amount of middle distillate is large, the viscosity becomes low and the lubricating property becomes worse. On the other hand, if the amount of the middle distillate is small, the ignitability and the combustion performance may become worse or the calorific value may become small.

The middle distillate is a fraction obtained by distilling of crude oil and desulfurizing. The middle distillate includes kerosene and gas oil fractions obtained from distillation processes, direct desulfurization gas oils obtained from direct residual desulfurization units, vacuum gas oils obtained from vacuum distillation processes, indirect desulfurization gas oils obtained from indirect desulfurization units, and fractions obtained by mixing two or more of these. The density (15° C.) of the middle distillate is preferably greater than or equal to 0.7600 g/cm$^3$, more preferably 0.8000 to 0.9000 g/cm$^3$. The aromatic content in the middle distillate is preferably 20.0 mass % or more, more preferably 30.0 mass % or more, and still more preferably 38.0 to 51.0 mass %.

Generally, a fuel oil composition for ships is manufactured by mixing a plurality of base component and an additive such as a low-temperature fluidity improver. Although an additive may be mixed in the fuel oil composition according to the present disclosure, it is preferable that a lubricity improver is not added to the base component when the base component and the additive are mixed.

The fuel oil composition according to the present disclosure is preferably used for fuel for ships.

EXAMPLES

Examples 1-9, Comparative Examples 1-9

The base components described in Tables 1 to 4 were mixed at the volume ratios described in Tables 5 to 8 to obtain the fuel oil compositions according to Examples 1 to 9 and Comparative Examples 1 to 9. The properties of the obtained fuel oil composition are shown in Tables 9 to 12. The base components in the table are as follows, and their properties are shown in Tables 1 to 4. The properties of the base components and the fuel oil composition were measured as described later.

Residue A: Desulfurization Residue
Residue B: Desulfurization Residue
Residue C: Desulfurization Residue
Residue D: Desulfurization Residue
Residue E: Desulfurization Residue
Vacuum gas oil F: Vacuum distillate gas oil (VGO)
Middle distillate G: A blend of direct residual desulfurized gas oil and indirect desulfurized gas oil
Middle distillate H: Direct desulfurized gas oil
Middle distillate I: Kerosene
Cracking fraction J: Direct cracked gas oil (LCO or Light cycle oil)
Cracking fraction K: Direct cracked gas oil (LCO)
Cracking fraction L: A blend of direct cracking heavy oil (HCO or Heavy cycle oil) and slurry oil (SLO)
Cracking fraction M: A blend of direct cracking heavy oil (HCO) and slurry oil (SLO)
Cracking fraction N: Direct cracked gas oil (LCO)
Cracking fraction O: A blend of direct cracked heavy oil (HCO) and slurry oil (SLO)

Density (15° C.):

Measurements were made according to JIS K 2249 "Crude Oil and Petroleum Products-Density Test Methods and Density-Weight-Volume Tables".

Kinematic viscosity (50° C.):

Measurements were made according to JIS K 2283 "Crude Oil and Petroleum Products-Kinetic Viscosity Test Methods and Viscosity Index Calculation Methods".

Sulfur Content:

Measurements were made according to JIS K 2541-4 "Crude Oil and Petroleum Products-Sulfur Test Methods, Part 4: Radioactive Excitation Methods".

CCAI:

This index focuses on the relationship between aromatic content and ignitability and combustion performance, and the aromaticity is conveniently calculated by the following formula using the density and kinematic viscosity of heavy oil.

$$CCAI = D - 140.7 \log\{\log(V + 0.85)\} - 80.6$$

Where D is the density (kg/kg m$^3$@15° C.) and V is the kinematic viscosity (mm$^2$/s@50° C.).

Pour Point (° C.):

Measurements were made according to JIS K 2269 "The pour point of crude oil and petroleum products and the cloud point test methods of petroleum products".

Flash Point (° C.):

Measurements were made according to JIS K 2265-3 "How to determine the flash point-Part 3: Pensky Martens sealing method".

Estimated Cetane Number:

Estimates were made according to tests based on IP541 "Determination of ignition and combustion characteristics of residual fuels—Constant volume combustion chamber method".

Existing Sludge (Mass %):

This is the actual sediment obtained by ISO10307-1 "Petroleum Products—Total Sediment in residual fuel oils Part 1 Determination by hot filtration".

Potential Sludge (Mass %):

Potential sediment obtained by ISO10307-2 "Petroleum Products—Total Sediment in residual fuel oils Part 2 Determination using standard procedures for ageing".

Ash (Mass %):

Measurements were made according to JIS K 2272 "Crude Oil and Petroleum Products-Ash and Sulfate Ash Test Methods".

Carbon Residue Content:

Measurements were made according to JIS K 2270 "Crude Oil and Petroleum Products-Test Methods for Carbon Residue".

Spot Score:

Determination was made according to ASTM D 4740-04 "Standard Test Method for Cleanliness and Compatibility of Residual Fuels by Spot Test".

Paraffin Content, Aromatic Content, Resin Content, and Asphaltene Content (Mass %):

Measurements were made according to JPI-5S-70-2010 method "Compositional Analysis Test Methods by TLC/FID Method".

TABLE t

| | Residue A | Residue B | Residue C | Residue D |
|---|---|---|---|---|
| Density (g/cm$^3$) | 0.9326 | 0.9086 | 0.9187 | 0.9347 |
| Kinematic viscosity 50° C. (mm$^2$/s) | 164.9 | 75.87 | 98.84 | 184.8 |
| Sulfur content (mass %) | 0.40 | 0.26 | 0.29 | 0.72 |
| CCAI (-) | 803 | 789 | 796 | 804 |
| Pour point (° C.) | 10.0 | 27.5 | 22.5 | 22.5 |
| Flash point (° C.) | 204.5 | 198.5 | 136.5 | 198.5 |
| Ash (mass %) | 0.003 | <0.001 | <0.001 | 0.002 |
| Carbon residue content (mass %) | 4.90 | 2.39 | 3.11 | 5.83 |
| Paraffin content (mass %) | 37.2 | 48.2 | 35.8 | 34.5 |
| Aromatic content (mass %) | 56.8 | 49.2 | 59.2 | 55.8 |
| Resin content (mass %) | 1.6 | 1.3 | 1.2 | 3.3 |
| Asphaltene content (mass %) | 4.4 | 1.3 | 3.8 | 6.4 |

TABLE 2

| | Residue E | Vacuum gas oil F | Middle distillate G | Middle distillate H |
|---|---|---|---|---|
| Density (g/cm$^3$) | 0.9906 | 0.8952 | 0.8769 | 0.8635 |
| Kinematic viscosity 50° C. (mm$^2$/s) | 1341 | 27.22 | 4.425 | 2.754 |
| Sulfur content (mass %) | 1.22 | 0.08 | 0.03 | 0.06 |
| CCAI (-) | 840 | 792 | 816 | 819 |
| Pour point (° C.) | −7.5 | 32.5 | 0.0 | −5.0 |
| Flash point (° C.) | 124.5 | 200.5 | 130.5 | 83.5 |
| Ash (mass %) | 0.018 | 0.002 | <0.001 | <0.001 |
| Carbon residue content (mass %) | 14.18 | 0.04 | <0.01 | <0.01 |
| Paraffin content (mass %) | 12.7 | 61.8 | 60.8 | 49.1 |
| Aromatic content (mass %) | 69.4 | 37.9 | 38.8 | 50.3 |
| Resin content (mass %) | 4.9 | 0.3 | 0.3 | 0.5 |
| Asphaltene content (mass %) | 13.0 | 0.0 | 0.1 | 0.1 |

TABLE 3

| | Middle distillate I | Cracking fraction J | Cracking fraction K | Cracking fraction L |
|---|---|---|---|---|
| Density (g/cm$^3$) | 0.7949 | 0.9503 | 0.9305 | 1.0560 |
| Kinematic viscosity 50° C. (mm$^2$/s) | 1.039 | 2.335 | 2.231 | 122.3 |
| Sulfur content (mass %) | 0.17 | 0.33 | 0.37 | 0.85 |
| CCAI (-) | 793 | 912 | 894 | 930 |
| Pour point (° C.) | −52.5 | −22.5 | −12.5 | 2.5 |
| Flash point (° C.) | 46.5 | 84.5 | 69.5 | 134.5 |
| Ash (mass %) | <0.001 | 0.001 | <0.001 | 0.022 |
| Carbon residue content (mass %) | <0.01 | <0.01 | <0.01 | 6.62 |
| Paraffin content (mass %) | 50.2 | 21.0 | 25.6 | 11.8 |
| Aromatic content (mass %) | 40.4 | 78.1 | 73.5 | 85.9 |
| Resin content (mass %) | 8.6 | 0.8 | 0.9 | 2.0 |
| Asphaltene content (mass %) | 0.8 | 0.1 | 0.0 | 0.3 |

TABLE 4

| | Cracking fraction M | Cracking fraction N | Cracking fraction O |
|---|---|---|---|
| Density (g/cm$^3$) | 1.0530 | 0.9484 | 1.0747 |
| Kinematic viscosity 50° C. (mm$^2$/s) | 148.6 | 2.270 | 159.5 |
| Sulfur content (mass %) | 1.10 | 0.25 | 0.67 |
| CCAI (-) | 925 | 911 | 946 |

TABLE 4-continued

| | Cracking fraction M | Cracking fraction N | Cracking fraction O |
|---|---|---|---|
| Pour point (° C.) | 10.0 | −22.5 | 10.0 |
| Flash point (° C.) | 69.5 | 134.5 | 69.5 |
| Ash (mass %) | 0.058 | <0.001 | 0.017 |
| Carbon residue content (mass %) | 6.58 | <0.01 | 7.35 |
| Paraffin content (mass %) | 12.1 | 17.0 | 7.6 |
| Aromatic content (mass %) | 86.9 | 82.6 | 90.6 |
| Resin content (mass %) | 0.9 | 0.4 | 1.5 |
| Asphaltene content (mass %) | 0.1 | 0.0 | 0.3 |

TABLE 5

| Base component (Unit) | Example 1 | Example 2 | Example 3 | Example 4 | Example 5 |
|---|---|---|---|---|---|
| Residue A (vol %) | 30.0 | 30.0 | — | — | — |
| Residue B (vol %) | — | — | 70.0 | — | 30.0 |
| Residue C (vol %) | — | — | — | — | — |
| Residue D (vol %) | — | — | — | 30.0 | — |
| Residue E (vol %) | — | — | — | — | — |
| Vacuum gas oil F (vol %) | — | — | — | — | — |
| Middle distillate G (vol %) | 40.0 | 40.0 | — | — | — |
| Middle distillate H (vol %) | — | — | — | 40.0 | 40.0 |
| Middle distillate I (vol %) | — | — | — | — | — |
| Cracking fraction J (vol %) | 15.0 | — | — | — | — |
| Cracking fraction K (vol %) | — | — | 20.0 | 15.0 | — |
| Cracking fraction L (vol %) | 15.0 | 30.0 | — | — | — |
| Cracking fraction M (vol %) | — | — | 10.0 | 15.0 | 30.0 |
| Cracking fraction N (vol %) | — | — | — | — | — |
| Cracking fraction O (vol %) | — | — | — | — | — |

TABLE 6

| Base component (Unit) | Example 6 | Example 7 | Example 8 | Example 9 |
|---|---|---|---|---|
| Residue A (vol %) | — | — | — | 100.0 |
| Residue B (vol %) | 35.0 | — | — | — |
| Residue C (vol %) | — | 60.0 | 60.0 | — |
| Residue D (vol %) | — | — | — | — |
| Residue E (vol %) | — | — | — | — |
| Vacuum gas oil F (vol %) | — | — | — | — |
| Middle distillate G (vol %) | — | — | — | — |
| Middle distillate H (vol %) | 35.0 | — | — | — |
| Middle distillate I (vol %) | — | — | — | — |
| Cracking fraction J (vol %) | — | — | — | — |
| Cracking fraction K (vol %) | — | — | — | — |
| Cracking fraction L (vol %) | — | — | — | — |
| Cracking fraction M (vol %) | 30.0 | — | — | — |
| Cracking fraction N (vol %) | — | 40.0 | — | — |
| Cracking fraction O (vol %) | — | — | 40.0 | — |

TABLE 7

| Base component (Unit) | Comparative Example 1 | Comparative Example 2 | Comparative Example 3 | Comparative Example 4 | Comparative Example 5 |
|---|---|---|---|---|---|
| Residue A (vol %) | — | — | — | — | — |
| Residue B (vol %) | — | — | — | — | 75.5 |

TABLE 7-continued

| Base component (Unit) | | Comparative Example 1 | Comparative Example 2 | Comparative Example 3 | Comparative Example 4 | Comparative Example 5 |
|---|---|---|---|---|---|---|
| Residue C | (vol %) | — | — | — | — | — |
| Residue D | (vol %) | — | — | — | — | 12.5 |
| Residue E | (vol %) | — | — | — | — | 8.0 |
| Vacuum gas oil F | (vol %) | 30.0 | 70.0 | 65.0 | 100.0 | — |
| Middle distillate G | (vol %) | — | — | — | — | — |
| Middle distillate H | (vol %) | — | — | — | — | — |
| Middle distillate I | (vol %) | — | — | — | — | 4.0 |
| Cracking fraction J | (vol %) | 30.0 | — | 35.0 | — | — |
| Cracking fraction K | (vol %) | — | — | — | — | — |
| Cracking fraction L | (vol %) | 40.0 | 30.0 | — | — | — |
| Cracking fraction M | (vol %) | — | — | — | — | — |
| Cracking fraction N | (vol %) | — | — | — | — | — |
| Cracking fraction O | (vol %) | — | — | — | — | — |

TABLE 8

| Base component (Unit) | | Comparative Example 6 | Comparative Example 7 | Comparative Example 8 | Comparative Example 9 |
|---|---|---|---|---|---|
| Residue A | (vol %) | — | — | — | — |
| Residue B | (vol %) | 75.5 | — | — | — |
| Residue C | (vol %) | — | — | — | — |
| Residue D | (vol %) | 12.5 | — | — | — |
| Residue E | (vol %) | 8.0 | — | — | — |
| Vacuum gas oil F | (vol %) | — | — | — | — |
| Middle distillate G | (vol %) | — | 100.0 | — | — |
| Middle distillate H | (vol %) | — | — | — | — |
| Middle distillate I | (vol %) | — | — | — | — |
| Cracking fraction J | (vol %) | 4.0 | — | 100.0 | — |
| Cracking fraction K | (vol %) | — | — | — | — |
| Cracking fraction L | (vol %) | — | — | — | 100.0 |
| Cracking fraction M | (vol %) | — | — | — | — |
| Cracking fraction N | (vol %) | — | — | — | — |
| Cracking fraction O | (vol %) | — | — | — | — |

TABLE 9

| | Example 1 | Example 2 | Example 3 | Example 4 |
|---|---|---|---|---|
| Density (g/cm$^3$) | 0.9316 | 0.9477 | 0.9271 | 0.9239 |
| Kinematic viscosity 50° C. (mm$^2$/s) | 13.26 | 22.85 | 26.46 | 10.98 |
| Sulfur content (mass %) | 0.32 | 0.41 | 0.38 | 0.48 |
| CCAI (-) | 842 | 848 | 824 | 839 |
| Pour point (° C.) | −2.5 | −5.0 | 22.5 | −2.5 |
| Flash point (° C.) | 116.5 | 140.5 | 100.0 | 88.0 |
| Estimated cetane number (-) | 22.7 | 20.7 | 38.9 | 24.4 |
| Existing sludge (mass %) | <0.01 | <0.01 | <0.01 | <0.01 |
| Potential sludge (mass %) | 0.04 | 0.01 | 0.02 | 0.04 |
| Ash (mass %) | 0.003 | 0.003 | 0.001 | 0.006 |
| Carbon residue content (mass %) | 2.00 | 2.92 | 1.95 | 2.26 |
| Spot score (-) | 1 | 1 | 2 | 1 |
| Paraffin content (mass %) | 40.4 | 39.0 | 40.1 | 35.6 |
| Aromatic content (mass %) | 57.2 | 58.3 | 57.8 | 60.9 |
| Resin content (mass %) | 1.0 | 1.2 | 1.2 | 1.5 |
| Asphaltene content (mass %) | 1.4 | 1.5 | 0.9 | 2.0 |
| PAs/ArR *1 (-) | 0.72 | 0.68 | 0.69 | 0.60 |

*1: (paraffin content + asphaltene content)/(aromatic content + resin content) (mass/mass)

TABLE 10

| | Example 5 | Example 6 | Example 7 | Example 8 | Example 9 |
|---|---|---|---|---|---|
| Density (g/cm$^3$) | 0.93341 | 0.9363 | 0.9295 | 0.9807 | 0.9326 |
| Kinematic viscosity 50° C. (mm$^2$/s) | 13.81 | 16.56 | 14.19 | 102.0 | 164.9 |
| Sulfur content (mass %) | 0.46 | 0.47 | 0.27 | 0.45 | 0.40 |
| CCAI (-) | 844 | 843 | 839 | 857 | 803 |
| Pour point (° C.) | 7.5 | 10.0 | 5.0 | 7.5 | 10.0 |
| Flash point (° C.) | 94.5 | 96.5 | 101.5 | 166.5 | 204.5 |
| Estimated cetane number (-) | 24.0 | 25.7 | 34.6 | 21.9 | 38.6 |
| Existing sludge (mass %) | 0.02 | 0.01 | <0.01 | <0.01 | <0.01 |
| Potential sludge (mass %) | 0.05 | 0.02 | <0.01 | <0.01 | 0.06 |
| Ash (mass %) | 0.007 | 0.008 | 0.003 | 0.005 | 0.003 |
| Carbon residue content (mass %) | 2.28 | 2.27 | 2.05 | 4.06 | 4.90 |
| Spot score (-) | 2 | 2 | 1 | 1 | 1 |
| Paraffin content (mass %) | 37.7 | 37.7 | 28.3 | 24.5 | 37.2 |
| Aromatic content (mass %) | 61.0 | 60.9 | 68.6 | 71.8 | 56.8 |
| Resin content (mass %) | 0.9 | 0.9 | 0.9 | 1.3 | 1.6 |
| Asphaltene content (mass %) | 0.5 | 0.5 | 2.3 | 2.4 | 4.4 |
| PAs/ArR *1 (-) | 0.62 | 0.62 | 0.44 | 0.37 | 0.71 |

*1: (paraffin content + asphaltene content)/(aromatic content + resin content) (mass/mass)

TABLE 11

| | Comparative Example 1 | Comparative Example 2 | Comparative Example 3 | Comparative Example 4 |
|---|---|---|---|---|
| Density (g/cm$^3$) | 0.9757 | 0.9432 | 0.9137 | 0.8952 |
| Kinematic viscosity 50° C. | 15.27 | 34.07 | 9.564 | 27.22 |

TABLE 11-continued

| | Comparative Example 1 | Comparative Example 2 | Comparative Example 3 | Comparative Example 4 |
|---|---|---|---|---|
| ($mm^2/s$) | | | | |
| Sulfur content (mass %) | 0.47 | 0.34 | 0.17 | 0.08 |
| CCAI (-) | 884 | 836 | 832 | 792 |
| Pour point (° C.) | −2.5 | 7.5 | 22.5 | 32.5 |
| Flash point (° C.) | 105.5 | 174.5 | 104.5 | 200.5 |
| Estimated cetane number (-) | 12.6 | 34.4 | 47.4 | 59.6 |
| Existing sludge (mass %) | 0.01 | <0.01 | <0.01 | <0.01 |
| Potential sludge (mass %) | 0.02 | 0.11 | <0.01 | <0.01 |
| Ash (mass %) | 0.007 | 0.004 | <0.001 | 0.002 |
| Carbon residue content (mass %) | 2.01 | 1.37 | 0.10 | 0.04 |
| Spot score (-) | 1 | 2 | 1 | 1 |
| Paraffin content (mass %) | 29.6 | 46.8 | 44.3 | 61.8 |
| Aromatic content (mass %) | 69.2 | 52.3 | 54.7 | 37.9 |
| Resin content (mass %) | 1.1 | 0.8 | 0.9 | 0.3 |
| Asphaltene content (mass %) | 0.2 | 0.1 | 0.1 | 0.0 |
| PAs/ArR *1 (-) | 0.42 | 0.88 | 0.80 | 1.62 |

*1: (paraffin content + asphaltene content)/(aromatic content + resin content) (mass/mass)

TABLE 12

| | Comparative Example 5 | Comparative Example 6 | Comparative Example 7 | Comparative Example 8 | Comparative Example 9 |
|---|---|---|---|---|---|
| Density ($g/cm^3$) | 0.9143 | 0.9194 | 0.8769 | 0.9503 | 1.0560 |
| Kinematic viscosity 50° C. ($mm^2/s$) | 68.60 | 75.09 | 4.425 | 2.335 | 122.3 |
| Sulfur content (mass %) | 0.40 | 0.40 | 0.03 | 0.33 | 0.85 |
| CCAI (-) | 796 | 800 | 816 | 912 | 930 |
| Pour point (° C.) | 27.5 | 25.0 | 0.0 | −22.5 | 2.5 |
| Flash point (° C.) | 103.0 | 138.0 | 130.5 | 84.5 | 134.5 |
| Estimated cetane number (-) | 47.1 | 44.4 | 36.1 | 5.3 | 6.0 |
| Existing sludge (mass %) | 0.04 | 0.02 | <0.01 | <0.01 | 0.02 |
| Potential sludge (mass %) | 0.24 | 0.14 | <0.01 | <0.01 | 0.02 |
| Ash (mass %) | 0.001 | 0.003 | <0.001 | 0.001 | 0.022 |
| Carbon residue content (mass %) | 3.70 | 3.41 | <0.01 | <0.01 | 6.62 |
| Spot score (-) | 1 | 1 | 1 | 1 | 1 |
| Paraffin content (mass %) | 43.7 | 42.7 | 60.8 | 26.4 | 11.8 |
| Aromatic content (mass %) | 51.3 | 52.6 | 38.8 | 73.6 | 85.9 |
| Resin content (mass %) | 2.1 | 1.8 | 0.3 | 0.0 | 2.0 |
| Asphaltene content (mass %) | 2.9 | 2.8 | 0.1 | 0.0 | 0.3 |
| PAs/ArR *1 (-) | 0.87 | 0.84 | 1.56 | 0.36 | 0.14 |

*1: (paraffin content + asphaltene content)/(aromatic content + resin content) (mass/mass)

The invention claimed is:

1. A fuel oil composition wherein;

a sulfur content is 0.50 mass % or less and an aromatic content is 50.0 to 75.0 mass %, a mass ratio of sum of paraffin and asphaltene to the sum of aromatic and resin is 0.20 to 0.80, wherein the paraffin, the asphaltene, the aromatic and the resin are measured using a TLC/FID method respectively, a CCAI is 860 or less, a kinematic viscosity (50° C.) is 10.00 to 180.0 $mm^2/s$, and a pour point is 25.0° C. or less, wherein the resin content is 2.0 mass % or less, and having a content of desulfurization residue of 30.0 to 70.0 volume % and a content of cracked material of 10.0 to 50.0 volume %.

2. The fuel oil composition according to claim 1, which contains a desulfurization residue in an amount of 30.0 volume %.

3. The fuel oil composition according to claim 2, wherein the desulfurization residue comprises an aromatic in an amount of 45.0 to 70.0 mass %.

4. The fuel oil composition according to claim 1, wherein the asphaltene content is 2.5 mass % or less.

5. The fuel oil composition according to claim 1, wherein the asphaltene content is 5.0 mass % or less.

6. The fuel oil composition according to claim 1, wherein the resin content is 0.2 to 2.0 mass %.

7. The fuel oil composition according to claim 1, wherein the resin content is 0.5 to 1.6 mass %.

8. The fuel oil composition according to claim 1, which contains a desulfurization residue in an amount of 70.0 volume %.

9. The fuel oil composition according to claim 1, which contains a desulfurization residue in an amount of 30.0 to 50.0 volume %.

10. The fuel oil composition according to claim 1, which includes a middle distillate.

11. The fuel oil composition according to claim 1, which has a kinematic viscosity (50° C.) of 25.0 to 110.0 $mm^2/s$.

12. The fuel oil composition according to claim 1, wherein the mass ratio of the sum of paraffin and asphaltene to the sum of aromatic and resin is 0.37 to 0.75.

13. The fuel oil composition according to claim 1, wherein the mass ratio of the sum of paraffin and asphaltene to the sum of aromatic and resin is 0.37 to 0.72.

14. The fuel oil composition according to claim 1, wherein the content of cracked material is 10.0 to 30.0 volume %.

15. The fuel oil composition according to claim 1, wherein the content of cracked material is 10.0 volume %.

* * * * *